US007548626B2

(12) United States Patent
Stenberg et al.

(10) Patent No.: US 7,548,626 B2
(45) Date of Patent: Jun. 16, 2009

(54) DETECTION AND CONTROL OF DIAPHRAGM COLLAPSE IN CONDENSER MICROPHONES

(75) Inventors: Lars Jørn Stenberg, Roskilde (DK); Jens Kristian Poulsen, Hedehusene (DK); Aart Zeger Van Halteren, Hobrede (NL)

(73) Assignee: Sonion A/S, Roskilde (DK)

( * ) Notice: Subject to any disclaimer, the term of this patent is extended or adjusted under 35 U.S.C. 154(b) by 960 days.

(21) Appl. No.: 11/133,877

(22) Filed: May 20, 2005

(65) Prior Publication Data

US 2006/0008097 A1 Jan. 12, 2006

Related U.S. Application Data

(60) Provisional application No. 60/572,763, filed on May 21, 2004.

(51) Int. Cl.
*H04R 3/00* (2006.01)

(52) U.S. Cl. ..... 381/113; 381/111; 381/174

(58) Field of Classification Search ..... 381/55, 381/91, 95, 111–115, 122, 174, 175, 190, 381/191; 310/322, 324, 326, 327, 334
See application file for complete search history.

(56) References Cited

U.S. PATENT DOCUMENTS

| | | | | |
|---|---|---|---|---|
| 4,439,641 | A * | 3/1984 | Paglia | 367/181 |
| 5,870,482 | A | 2/1999 | Leoppert et al. | |
| 5,949,892 | A * | 9/1999 | Stewart | 381/113 |
| 6,088,463 | A * | 7/2000 | Rombach et al. | 381/174 |
| 6,218,883 | B1 * | 4/2001 | Takeuchi | 327/318 |
| 6,516,069 | B1 * | 2/2003 | Takeuchi et al. | 381/122 |
| 6,812,620 | B2 * | 11/2004 | Scheeper et al. | 310/324 |
| 7,110,560 | B2 * | 9/2006 | Stenberg | 381/113 |
| 2002/0050172 | A1 | 5/2002 | Toyoda et al. | |
| 2007/0237345 | A1 * | 10/2007 | Zhang et al. | 381/113 |
| 2008/0075306 | A1 * | 3/2008 | Poulsen et al. | 381/111 |
| 2008/0101641 | A1 * | 5/2008 | Miles | 381/355 |

FOREIGN PATENT DOCUMENTS

| | | |
|---|---|---|
| JP | 2001295925 | 10/2001 |
| WO | WO 96/22515 | 7/1996 |
| WO | WO 02/098166 A1 | 12/2002 |

OTHER PUBLICATIONS

Capacitive Stabilization of an Electrostatic Actuator: An Output Feedback Viewpoint, D.H.S. Maithripala, Texas Tech University, Jun. 4-6, 2003, pp. 4053-4058.
Fabricating Capacitive Micromachined Ultrasonic Transducers With Wafer-Bonding Technology, Yongli Huang, Journal of Microelectromechanical Systems, vol. 12 No. 2, Apr. 2003.
European Search Report dated Feb. 1, 2005.
Stabilization of Electrostatically Actuated Mechanical Devices, Joseph I. Seeger, Jun. 16-19, 1997.

* cited by examiner

*Primary Examiner*—Xu Mei
(74) *Attorney, Agent, or Firm*—Nixon Peabody LLP

(57) ABSTRACT

A condenser microphone is provided having a transducer element. A diaphragm has an electrically conductive portion. A back-plate has an electrically conductive portion. A DC bias voltage element is operatively coupled to the diaphragm and the back-plate. A collapse detection element is adapted to determine a physical parameter value related to a separation between the diaphragm and the back-plate. A collapse control element is adapted to control the DC bias voltage element based on the determined physical parameter value.

30 Claims, 4 Drawing Sheets

DETECTION AND CONTROL OF DIAPHRAGM COLLAPSE IN CONDENSER MICROPHONES

PRIORITY

This application claims the benefit of priority under 35 U.S.C. §119 of provisional application Ser. No. 60/572,763, filed May 21, 2004, the contents of which are hereby incorporated by reference in their entirety as if fully set forth.

FIELD OF THE INVENTION

The present invention relates to a condenser microphone having a detection element adapted to determine a physical parameter value related to a separation between a transducer element diaphragm and a back-plate, and a collapse control element adapted to control a DC bias voltage of the transducer element based on the determined physical parameter value.

BACKGROUND OF THE INVENTION

It is well-known that electrostatic actuators and sensors may enter an undesired so-called collapsed state under certain operating conditions such as, e.g., when exposed to extraordinarily high sound pressure levels or a mechanical shock.

The collapsed state is characterized by a "collapse" or sticktion between the diaphragm and the back-plate, such as that described in PCT patent application WO 02/098166 which discloses a silicon transducer element. When a polarity of an incoming sound pressure is such that the diaphragm, usually the moveable plate, is deflected towards the back-plate, the force originating from an impinging sound pressure is combined with an attractive force originating from a DC electrical field provided between the diaphragm and the back-plate. When a sum of these forces exceeds a predetermined critical value, an opposing force provided by a diaphragm suspension will be insufficient to prevent the diaphragm from approaching and contacting the back-plate, causing the microphone to enter a collapsed state. The diaphragm can only be released from the back-plate once the attractive force originating from the DC electrical field acting on the diaphragm has been removed or at least significantly reduced in magnitude.

U.S. Pat. No. 5,870,482 discloses a silicon microphone where mechanical countermeasures have been included to prevent diaphragm collapse by restricting maximum deflection of the microphone diaphragm to less than a collapse limit which in the disclosed microphone construction is about 1 μm.

In silicon condenser microphones where no special means have been applied to prevent collapse of the diaphragm, fully or at least party removing the microphone DC bias voltage will remedy the collapsed state and secure that the transducer element returns to a normal or quiescent state of operation. Usually, the diaphragm and the back-plate condenser plates have both been treated with a non-conducting anti-sticktion coating which will prevent Van der Waal forces from keeping the diaphragm sticking even if the DC bias voltage that generates the DC electrical field between the transducer element diaphragm and back-plate has been removed (i.e., zeroed).

However, a collapse detection and control circuit adapted for use in condenser microphones has not yet been disclosed. The present invention is directed to satisfying this and other needs.

SUMMARY OF THE INVENTION

According to an embodiment of the invention, a condenser microphone is provided having a transducer element. A diaphragm has an electrically conductive portion. A back-plate has an electrically conductive portion. A DC bias voltage element is operatively coupled to the diaphragm and the back-plate. A collapse detection element is adapted to determine a physical parameter value related to a separation between the diaphragm and the back-plate. A collapse control element is adapted to control the DC bias voltage element based on the determined physical parameter value.

According to an embodiment of the invention, an electronic circuit is provided for a condenser microphone having a transducer element. The circuit includes a DC bias voltage element to couple to a condenser microphone diaphragm and a back-plate. A collapse detection element is adapted to determine a physical parameter value related to a separation between the diaphragm and the back-plate of the condenser microphone. A collapse control element is adapted to control the DC bias voltage element based on the determined physical parameter value.

According to an embodiment of the invention, a method of operating a condenser microphone is provided. An acoustic signal is transduced into an electrical signal with a transducing element. The transducing element has a diaphragm and a back-plate. A physical parameter value is determined that relates to a separation between the diaphragm and the back-plate. An appropriate separation between the diaphragm and the back-plate is maintained by controlling a DC bias voltage between the diaphragm and the back-plate.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

In the following, a preferred embodiment of the invention will be described with reference to the drawing, wherein.

Figure 1:
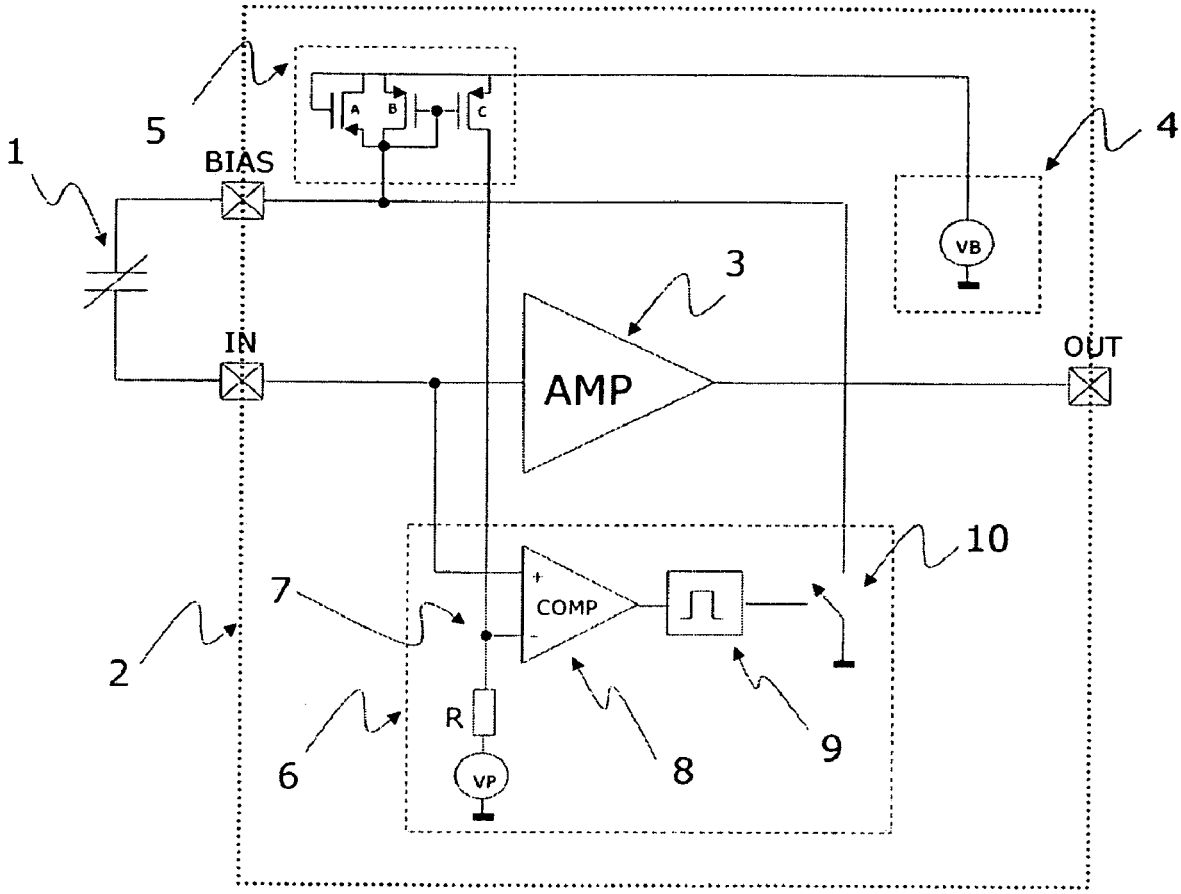
FIG. 1 shows a collapse detection and control circuit according to an embodiment of the invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

According to one embodiment of the invention, a condenser microphone is provided that has a transducer element. The transducer element includes a diaphragm having an electrically conductive portion. A back-plate of the transducer element has an electrically conductive portion. A DC bias voltage element of the transducer element is operatively coupled to the diaphragm and the back-plate. A collapse detection element of the transducer element is adapted to determine a physical parameter value related to a separation between the diaphragm and the back-plate. A collapse control element of the transducer element is adapted to control the DC bias voltage element based on the determined physical parameter value.

The collapse detection element is adapted to detect a separation or distance between the diaphragm and back-plate as a measure of the operating condition or state of the transducer element with respect to collapse. There will be no separation between the diaphragm and the back-plate in the event that a collapse has occurred. A very small separation indicates that the transducer element may be close to a collapse. A large separation or distance between the diaphragm and the back-plate indicates that the transducer element is in a safe operating condition, i.e., it is far from a collapse.

The collapse control element is adapted to control the DC bias voltage in order to control the operation state of the transducer element. In the event that a collapse has occurred, it is possible to remedy the collapsed state of the transducer element by reducing or completely removing the DC bias voltage. If a safe operation is detected or determined, the collapse control element provides a normal or nominal DC bias voltage. If the collapse detection element determines a separation between the diaphragm and the back-plate that is too low, it may be desirable to reduce the DC bias voltage and thus reduce the DC electrical field strength between the diaphragm and back-plate to prevent an approaching collapse from occurring.

The collapse detection element may be adapted to determine an instantaneous value of the physical parameter or short-term average value of the physical parameter. Since a single sound pressure peak may cause a collapse, it may be desirable to monitor a peak value, i.e., an instantaneous value of the physical parameter. However, it may be preferred to average the physical parameter value over a short time period, such as a time period in between 1 μs and 100 μs, or between 100 μs and 100 ms.

In some embodiments the collapse control element is adapted to avoid collapse of the transducer element. In alternative embodiments the collapse control element is adapted to allow collapse of the transducer element, and is adapted to remedy a collapsed condition by a discharge element operatively coupled to the transducer element. The collapse control element is further adapted to discharge the transducer element for a predetermined discharge time.

As described above, a first aspect of the invention provides a condenser microphone that can handle high sound pressure levels or drop induced shocks without entering an irreversible collapsed state. This latter condition could require a user to remove a microphone power supply and restart the microphone or the entire apparatus employing the microphone. This can be achieved by preventing a microphone collapse so that the transducer will remain operational without interruption of sound. Alternatively, a collapse can be remedied after its occurrence such that the microphone may malfunction during a certain predetermined period of time before a normal operational state of the transducer element has been re-established. However, such a malfunctional period of time may be acceptable for the user if the sound interruption is sufficiently short, such as shorter than three seconds, or preferably shorter than one second, such as less than 500 ms or 200 ms or preferably less than 100 ms. A condenser microphone may be exposed to high sound pressure levels at low frequencies by car door slams. However, during such circumstances a short interruption of sound from the microphone may be fully acceptable for the user if normal operation is resumed after, e.g., for example a few hundred milliseconds.

The collapse detection element may be adapted to determine a capacitance of the transducer element. The collapse detection element may be adapted to determine the physical parameter value by applying a probe signal to the transducer element and determining a value of a response to the probe signal. The probe signal may include a DC or ultrasonic signal.

In some embodiments, the collapse detection element includes a capacitive divider having a cascade between a fixed capacitor and the transducer element. In some embodiments, the collapse detection element may be responsive to a sound pressure impinging on the diaphragm. In these embodiments, the collapse detection element may include a sensor microphone positioned in proximity to the transducer element and operatively coupled to the collapse control element.

In additional embodiments, the collapse detection element is adapted to detect a peak voltage generated by the transducer element, i.e., an instantaneous output signal from the transducer element that is directly used as a physical parameter reflecting a sound pressure level to which the transducer element is exposed. In order not to disturb the normal function of the transducer element, the detection circuit may have an input buffer that does not load the transducer element significantly, i.e., the input buffer may exhibit a small input capacitance relative to the output capacitance of the transducer element.

Preferably, the collapse control element is adapted to reduce a DC bias voltage across the transducer element based on the determined physical parameter value. The collapse control element may include a bias current monitoring element adapted to detect a DC current flow from the DC bias voltage element to the transducer element. The collapse control element may be adapted to electrically connect the diaphragm and the back-plate upon the detected physical parameter value exceeding a predetermined threshold. Preferably, the collapse control element has a controllable element adapted to generate an electrical pulse with a predetermined duration and amplitude based on the determined physical parameter value. The collapse control element further includes a switch element adapted to receive the electrical pulse and to electrically connect the diaphragm and the back-plate in response thereto. The collapse control element may be adapted to reduce the DC bias voltage based on the determined physical parameter value.

In preferred embodiments, the transducer element has a silicon transducer or MEMS transducer. The silicon transducer may be implemented on a first silicon substrate, while the collapse detection element and the collapse control element are implemented on a second silicon substrate. The collapse detection element and the collapse control element are preferably monolithically integrated on a single die. The die may further comprise a preamplifier operatively coupled to the transducer element.

As indicated above, the preferred embodiments of the collapse detection element and collapse control element include electronic circuits which may make mechanical solutions obsolete and allow a higher degree of freedom in the mechanical construction of the transducer element. This is a significant design advantage with silicon and MEMS-based microphones. In addition, electronic solutions offer larger flexibility in a practical setting of a predetermined threshold level associated with a certain sound pressure level or a certain separation between the diaphragm and back-plate where the collapse control element is triggered. Accordingly, electronic circuit based collapse detection element allow simple customization to fit needs of any particular application.

Another aspect of the invention provides an electronic circuit for condenser microphones. The circuit has a DC bias voltage element to couple to a condenser microphone diaphragm and back-plate. A collapse detection element is adapted to determine a physical parameter value related to a separation between the diaphragm and the back-plate of the associated condenser microphone. A collapse control element is adapted to control the DC bias voltage element based on the determined physical parameter value.

The electronic circuit may be adapted for different types of transducer elements even without any modification, or by use of a limited number of adjustable parameters associated with the function of the collapse control element. The electronic circuit may be integrated on a separate semiconductor substrate or die or it may be monolithically integrated with the microphone transducer element, in particular in the event that the transducer element includes a silicon transducer element.

The collapse detection element may be adapted to determine a capacitance of the transducer element. Alternatively, the collapse detection element may be adapted to determine the physical parameter value by applying a probe signal to the transducer element. In a simple and advantageous embodiment of the invention, the collapse detection element is adapted to detect a transient peak signal voltage or peak voltage generated by the transducer element. This peak voltage may be reached subsequent to a collapse event so that the collapse event by itself generates a transient signal voltage from the transducer which exceeds a predetermined trigger voltage and activates the collapse control element.

The collapse control element may be adapted to reduce the DC bias voltage based on the determined physical parameter value. The collapse control element may include discharge element operatively coupled to the transducer element and is adapted to discharge the transducer element for a predetermined discharge time.

In the following embodiments, a collapse detection and control circuit suitable for integration into miniature silicon based condenser microphones is described. Several embodiments include a collapse detection circuit for detection of a separation between a diaphragm and a back-plate. Physical parameters such as voltage, capacitance and sound pressure can be used. The detection circuit should preferably not load the transducer element of the condenser microphone with any significant impedance (compared to the generator impedance of the transducer element itself). A silicon transducer element of a MEMS microphone has a very large impedance that substantially corresponds to a capacitance between 5-20 pF which makes meeting this requirement a significant challenge.

Several embodiments of collapse control circuits are also possible according to the invention and some are described in the following in combination with detection circuits. The collapse detection and control circuitry is preferably fabricated on a CMOS semiconductor substrate, such as a 0.35 μm mixed-mode CMOS process. This technology is flexible with both good analog and digital circuitry capabilities. The bias voltage circuitry for the condenser transducer element and preamplifiers may advantageously be integrated on the same semiconductor substrate. In this latter case, the CMOS process preferably includes high-voltage capabilities. Semiconductor devices, such as transistors, diodes, capacitors etc., can be used which can withstand respective terminal voltage differences above 10 V, or preferably above 15 or 20 V.

FIG. 1 shows a preferred embodiment of collapse detection and control circuit suitable for integration into a silicon based condenser microphone fabricated by MEMS techniques. A silicon transducer element of this condenser microphone has dimensions of 1.3×1.3 mm with an air gap between a back-plate and a diaphragm of approximately 1 μm and a nominal capacitance of about 5-15 pF. The detection circuit includes a peak voltage detector adapted to determine and flag every generated signal peak with a polarity which corresponds to a sound pressure moving the diaphragm towards the back-plate and which exceeds a predefined threshold level corresponding to a maximum safe sound pressure level.

As shown in FIG. 1, a condenser microphone element 1 or transducer element is connected to an integrated microphone preamplifier and microphone biasing and collapse detection and control circuitry indicated by the dashed box 2. A signal amplifier 3 or preamplifier is connected between input terminal IN and output terminal OUT. A DC bias voltage generator 4 provides a DC voltage, VB. A high impedance element and charge monitor circuit 5 with transistor elements A, B and C control the DC bias voltage applied to DC bias voltage terminal, BIAS. Collapse control circuitry 6 is indicated within a dashed box. The collapse control circuitry 6 has a voltage generator VP providing a predetermined threshold voltage for collapse control 7 in combination with a voltage drop across resistor R. A comparator 8 compares the threshold voltage for collapse control 7 with the input signal provided by the condenser microphone element 1 at terminal IN. Output from the comparator 8 is connected to a monostable pulse generator 9 that is connected to a bias voltage clamp switch 10, that preferably comprises a high-voltage NMOS transistor capable of connecting the bias terminal BIAS to ground through a relatively low resistance such as 10 Kohm or less to discharge the transducer element.

The high impedance element and charge monitor circuit 5 consists of two anti-parallel, diode-coupled P-channel MOSFETs A and B. The P-channel MOSFET C is an M-fold current mirror ensuring the current passing through the microphone connected to BIAS and IN is multiplied by a factor M. The collapse control circuit 6 compares the input signal at terminal IN with a threshold voltage 7 composed of a predefined portion VP and the voltage drop over the resistor R. The reference voltage 7 is designed so that during charging of the condenser microphone element 1, i.e., during start-up of a DC bias voltage generator VB 4 caused by an approaching collapse event, signal disturbances on terminal IN caused by the microphone charging process will not be able to trigger the comparator 8 and initiate a pulse for shutting down the bias by the clamp switch 10.

When the microphone is fully charged during normal operation, triggering of the clamp switch 10 will only take place if positive signal peaks on IN exceeds VP, reflecting a sound pressure level exceeding the desired predefined threshold voltage or level. If the predefined threshold voltage is selected so that it corresponds to a maximum safe sound pressure level for the transducer element, it is possible to discharge the transducer element prior to collapse and thus prevent a collapse.

Figure 2:
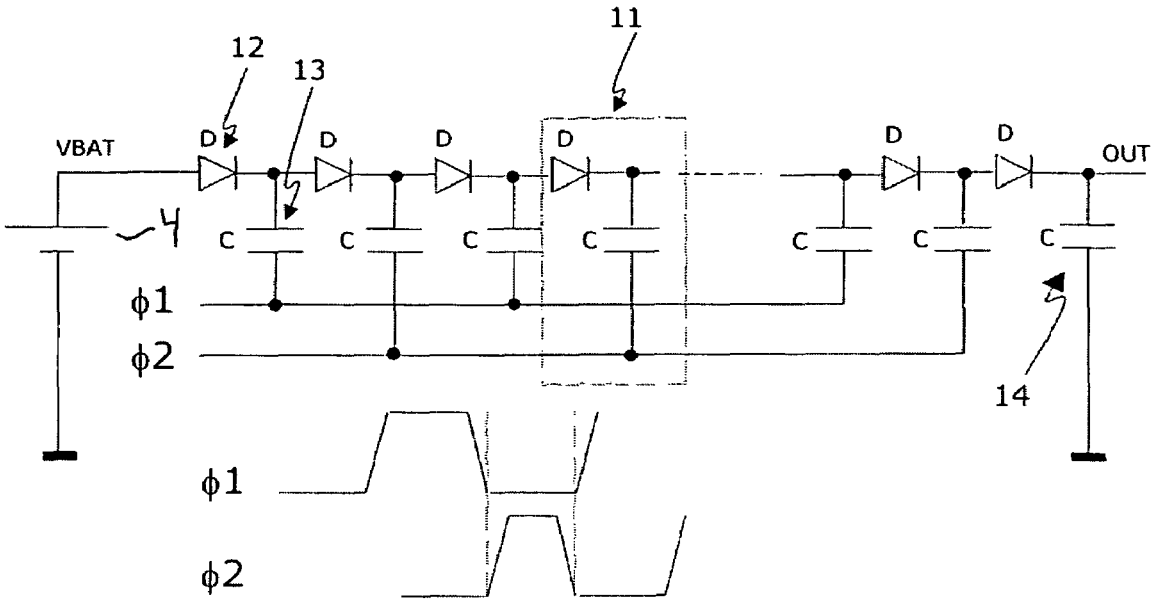
FIG. 2 shows a DC bias voltage generator according to an embodiment of the invention.

FIG. 2 shows a preferred embodiment for the bias voltage generator VB 4 of FIG. 1 comprising a Dickson voltage multiplier. VB 4 is adapted to provide a DC bias voltage of about 8-10 V to node BIAS by multiplying a VBAT voltage between 1.0 and 1.4 Volt. This type of voltage multiplier requires a clock with two, non-overlapping phases Ψ1 and Ψ2, as sketched at the bottom of FIG. 2. A DC voltage source, for example a battery, applies the DC voltage VBAT to the voltage multiplier. The voltage multiplier consists of a number of separate stages 11 coupled in series. Each stage 11 contains a diode "D" 12 and a capacitor "C" 13 where the bottom plate of, e.g., the capacitor 13 is coupled to Ψ1 while a capacitor of the subsequent stage is coupled to Ψ2 and so forth. An output DC voltage OUT is generated across a final capacitor C 14. All diodes such as diode 12 should preferably be types that show low current leakage and low parasitic capacitances to neighboring devices and circuit surroundings (substrate, clock, ground or power lines). This means that a preferred embodiment of the diodes includes a substrate-isolated type of diode such as a poly-silicon diode. In other embodiments, the diode D 12 may be a PN-junction diode, a Schottky diode or a diode coupled bipolar, or a field-effect transistor.

Figure 3:
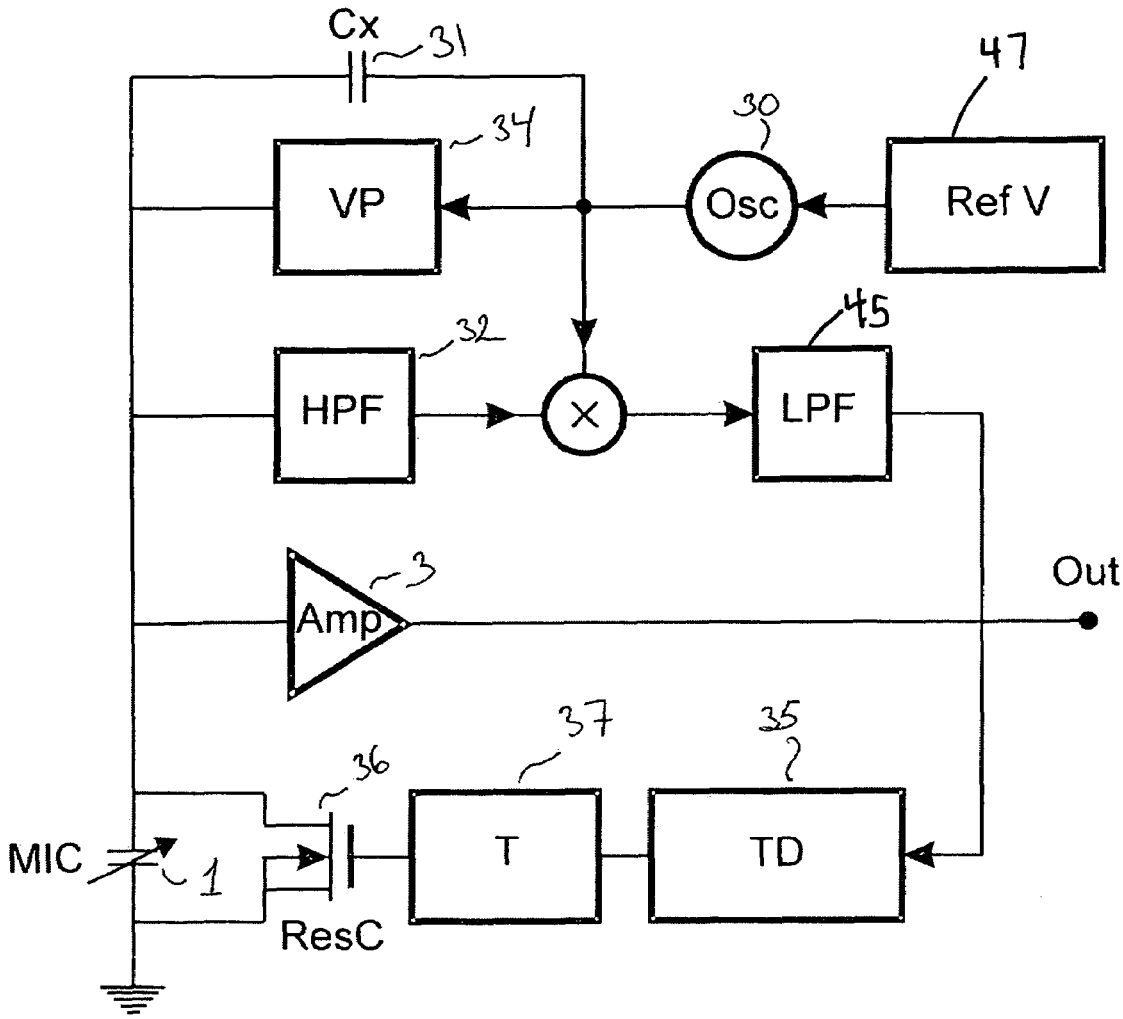
FIG. 3 shows a collapse detection and control circuit using a probe signal according to an embodiment of the invention.

FIG. 3 shows another embodiment of the invention where a detection circuit, relying on a high-frequency probe signal, transmits the probe signal through the transducer element and detects any significant change in capacitance of the transducer element that would indicate that the transducer element is collapsed or close to collapse.

In FIG. 3, a transducer element 1 of a condenser microphone is shown coupled to an output terminal "Out" via preamplifier "Amp" 3. A reference voltage Ref V 47 is generated and supplied to an oscillator 30. This is done so that the output of the oscillator 30 is well-defined. A voltage pump 34 ("VP") or voltage multiplier is operated on a clock frequency generated by the oscillator 30. VP 34 increases the reference voltage to the DC bias voltage of transducer element 1 of a MEMS microphone, typically in the range 10-20 V.

A portion of the AC voltage from the oscillator 30 is used as a high-frequency probe and fed to the transducer element 1 through a cascade coupled capacitor 31, Cx. The probe voltage drop across the capacitive transducer element 1 will be modulated by any incoming sound pressure due to the varying capacitance thereof.

In case of a collapse of the microphone diaphragm, the average separation between the diaphragm and the back-plate of the transducer element 1 will be significantly smaller than the nominal separation, i.e., the quiescent distance between the back-plate and diaphragm. Since the distance between these two plates is zero during collapse, the capacitance of the transducer element 1 will be substantially larger so as to result in a lower probe voltage across the transducer element 1 of the microphone. Likewise, a larger probe voltage will exist across the external capacitor 31. This latter signal is high pass filtered by high pass filter 32, HPF, to remove any audio information and eliminate DC-offset. The high frequency component is fed to an electronic multiplier X, which may comprise an analog multiplier such as a Gilbert cell, and is multiplied by the direct output of the oscillator 30.

The multiplication will result in sum and difference products of the angular oscillator frequency ω, in mathematical terms:

$$A_0*\cos(\omega t)*B_0*\cos(\omega t+\Psi)=\tfrac{1}{2}A_0B_0((\cos(2\omega t+\Psi)+\cos(\Psi)), \text{ where}$$

$A_0$ is the magnitude of the probe signal across the transducer element 1 and $B_0$ a constant associated with the multiplication process. After lowpass filtering LPF 45, the output is: $\tfrac{1}{2}A_0B_0\cos(\Psi)$, where Ψ is a small phase difference (Ψ<<1) between the high frequency probe signal across the transducer element 1 and the probe signal of the oscillator 30. The DC component of the demodulated probe signal is thus proportional to the probe voltage across the transducer element 1 and can be utilized to determine the state of the transducer element 1 by a simple threshold circuit or procedure with a predetermined threshold level.

By comparing the detection scheme described above to a scheme based on detection of the collapsed condition only based on a threshold trigger mechanism relative to the acoustic output, several possible advantages are visible. Detecting collapse by measuring the acoustic level from the microphone will cause difficulties in measuring collapse, if this occurs near the maximum acoustic level that is desirable to measure. Under these conditions, a collapse may go undetected if the trigger level is set too high, or if a collapse is detected while inside the normal working range. One way to ensure completely safe collapse prevention, even when the collapse level is close to the maximum acoustic level desirable to measure, is by setting the corner frequency to a lower frequency than the highpass filter 32. The corner frequency may be set, e.g., to a frequency of about 10-30 Hz.

The optimum noise margin for reliable detection of the collapsed state without generating false positive collapse detection events can be found as described in the following. If the capacitance of the microphone in quiescent operating is designated Cn, and in the collapsed condition Cc, a maximum sensitivity is obtained by choosing the value of the external feed capacitor Cx, integrated on-chip, as follows:

$$Cx=\tfrac{1}{2}(Cn+Cc)$$

It is preferred that respective manufacturing tolerances of Cn and Cc can be kept smaller than about 10-20%, in order to reliably and accurately detect a collapsed state of the transducer element 1. The high-frequency probe voltage across the transducer element 1 at the frequency of the oscillator 1 will have an amplitude larger than U/2, where U is the AC voltage provided by oscillator 30 during normal operation, and an amplitude lower than U/2 during a collapsed state.

As a numerical example, Cc may be 15 pF and Cn may be 5 pF. An optimal feed-forward capacitor is then Cx=10 pF.

It will finally be noted, that power is consumed due to the charging/discharging of the capacitors. During normal operation this power loss is:

$$P=f*U*U*(Cn*Cx)/(Cn+Cx),$$

If U=1 Volt, f=250 kHz and with the values above, power loss P will be:

$$P=0.25*6\ \mu W=1.5\ \mu W.$$

This value is acceptable also for low-power applications such as portable and battery operated mobile terminals and hearing prostheses.

In the case that the oscillator frequency is considerably higher than 250 kHz, it may be advantageous to divide it down with a fixed integer number N, and use this frequency instead for the multiplication outlined above. It is advantageous to main the same frequency for testing and mixing and that this frequency is placed outside the audible range. Also, it should preferably not be placed right at a high frequency resonance of the silicon microphone. Preferably, the high-frequency probe passed through the transducer element 1 has the same frequency as pump frequency used for the voltage pump 34, VP, that generates the DC bias voltage of across condenser plates of the transducer element 1. This choice is to avoid any unwanted mixing products between these two frequencies.

In another embodiment of the invention, several portions of the detection circuit of FIG. 3 are used and this embodiment is likewise based on a detecting parameters derived from a capacitive voltage divider. In the present embodiment, a change in DC voltage across the transducer element 1 is directly measured and used to indicate or detect which state the transducer element 1 has. This embodiment relies on detecting a collapsed state of the transducer element 1 by detecting a large DC shift of the signal voltage across the transducer element 1 caused by an abrupt change of capacitance of the transducer element 1. This abrupt change of capacitance changes a division of DC voltage between fixed capacitor 31 and the transducer element 1. The threshold detector TD 35 of FIG. 3 can detect the change of DC voltage. If the transducer element 1 and the microphone preamplifier 3 (FIG. 3) has a long settling time, it means that a collapse produces a long DC pulse.

Based on the detected threshold-by-threshold detector TD 35, a reset circuit ("ResC") 36 may be utilized. The reset circuit 36 may include a semiconductor switch of low impedance, such as lower than 25 Kohm or 10 Kohm, when activated. This active semiconductor switch serves to reduce or even null any DC voltage between the plates of the transducer element 1 for a predetermined period of time. A timer ("T") 37 is preferably included to provide a reduction or null of the DC bias voltage during a predetermined period of time, such as 1-100 ms, after which a collapsed state of the transducer element 1 can be assumed to be remedied.

Figure 4:
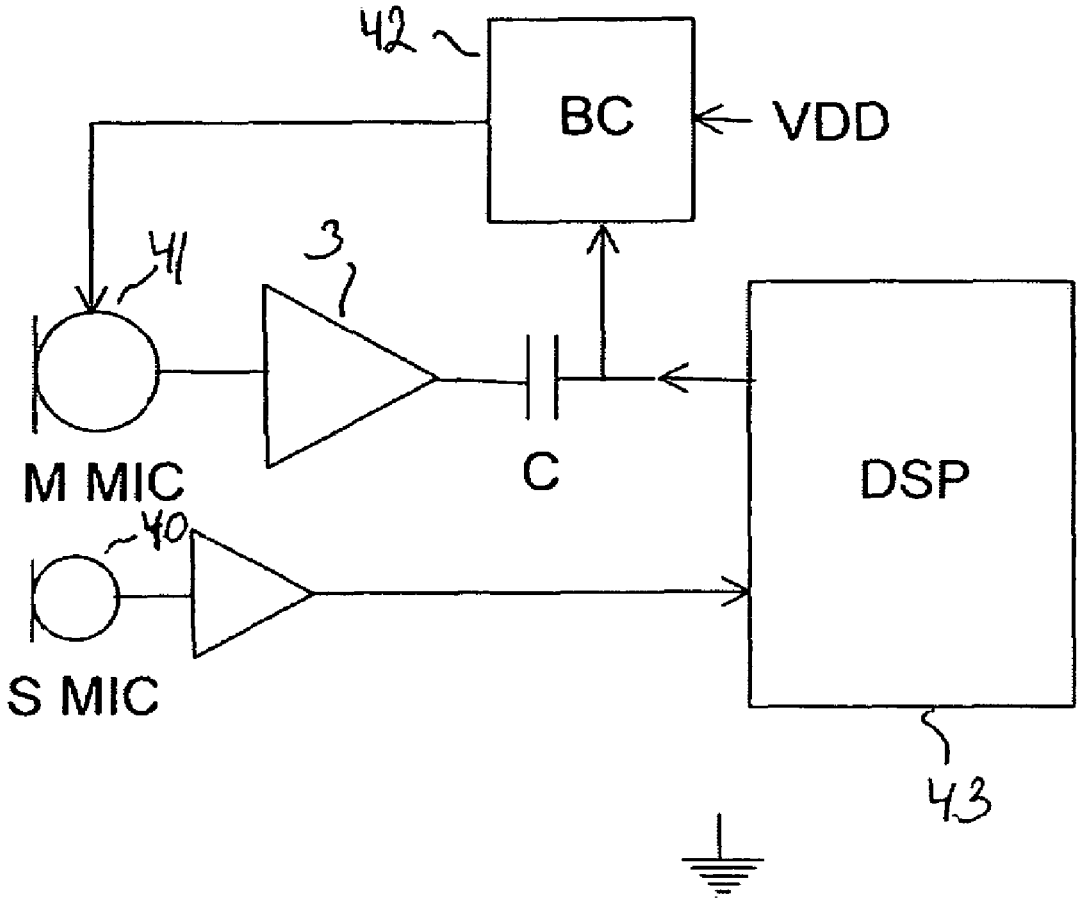
FIG. 4 shows a collapse detection circuit using a sensor microphone and a control circuit implemented using a Digital Signal Processor (DSP) according to an embodiment of the invention.

FIG. 4 shows an embodiment based on detecting a physical parameter value associated with a separation between diaphragm and back-plate of a silicon condenser microphone ("M MIC") 41 by sensing a sound pressure to which the condenser microphone is exposed by a dedicated sensor microphone ("S MIC") 40. The sensor microphone 40 and preamplifier 2 are added to the silicon substrate and amplifier circuit that already comprises the main microphone 41 and its associated preamplifier for which collapse detection and control are to be implemented.

The sensor microphone 40 is preferably substantially smaller than the main microphone 41 and may have a lower sensitivity. Preferably, the sensor microphone 40 has a collapse point or threshold which is around 10-30 dB higher in sound pressure level than the collapse threshold of the main microphone 41 so as to ensure that the sensor microphone 40 behaves in substantially linearly in the collapse region of the main microphone 41 for all envisioned main microphone variants. The output of the sensor microphone 40 is provided to the collapse control element ("BC") 42, which preferably operates by providing gradual decrease of DC bias voltage of a condenser transducer element (not shown) of the main microphone 41. It is preferred to hold the DC bias voltage of the sensor microphone 40 substantially constant.

According to the present embodiment of the invention, the main microphone 41 is supplied by bias voltage controlled by the bias voltage control element 42 that is supplied with a DC voltage which could be a battery voltage from a 1.30 Volt Zinc-air battery. The collapse detection and control element may comprise a DSP 43 adapted to control the bias voltage control circuit 42 based on an output signal of the sensor microphone 40. A control algorithm implemented in the DSP 43 may be adapted to either reduce the DC bias voltage to the main microphone 41 once a threshold sound pressure level is reached, or the DSP 43 may be adapted to reduce or even completely null the DC bias voltage if the instantaneous or short-term average incoming sound pressure level exceeds threshold sound pressure level to indicate a potential collapse of the main microphone 41.

The collapse control circuit may be based on a more sophisticated control of the DC bias voltage of the transducer element than the ones shown. Instead of clamping the DC bias voltage across the transducer element of the main microphone 41, the DC bias voltage may be gradually decreased in response to detecting an approach of collapse. This dynamic adoption of DC bias voltage based on the detected incoming sound pressure level will also be able break a positive feedback loop that causes the collapse. A safe operation region of the transducer element can be maintained. After an intermittent reduction of DC bias voltage, the DC bias voltage may advantageously be increased toward a nominal of DC bias voltage with a suitable predetermined release time constant. Such type of adaptive gradual control of the DC bias voltage may be implemented by a suitable piece of software or set of program instruction in the DSP 43.

This type of dynamic adoption of the DC bias voltage based on the detected incoming sound pressure level may also be added to any of the detection circuits shown in FIGS. 1 and 3.

In general, it may be desirable to implement at least parts of the collapse detection and control element using a DSP. It may be advantageous to utilize a DSP element already present in the associated apparatus, for example a programmable DSP of a mobile phone or a hearing aid. In this way, it is possible to minimize the need for additional components to implement the collapse detection and control. Using a DSP enables implementation of complex algorithms for both collapse detection and control.

The solutions according to the invention could be implemented either integrated into the microphone or, as shown in FIG. 1, the collapse detection and control circuits could be arranged on a separate Application Specific Integrated Circuit ("ASIC"). DC bias voltage circuits may be integrated with the collapse control circuit. If preferred, separate ASICs may be provided for the collapse detection circuit and the collapse control circuit.

The invention has a wide range of applications within miniature condenser microphones suited for portable communication devices such as mobile phones and hearing prostheses. Each of these embodiments and obvious variations thereof is contemplated as falling within the spirit and scope of the claimed invention, which is set forth in the following claims.

What is claimed is:

1. A condenser microphone comprising:

a transducer element comprising:

a diaphragm having an electrically conductive portion;

a back-plate having an electrically conductive portion;

a DC bias voltage element operatively coupled to the diaphragm and the back-plate;

a collapse detection element adapted to determine a physical parameter value related to a separation between the diaphragm and the back-plate; and a collapse control element adapted to control the DC bias voltage element based on the determined physical parameter value.

2. The condenser microphone according to claim 1, wherein the collapse detection element is adapted to determine at least one of an instantaneous value of the physical parameter, and a short-term average value of the physical parameter.

3. The condenser microphone according to claim 1, wherein the collapse control element is adapted to avoid collapse of the transducer element.

4. The condenser microphone according to claim 1, wherein the collapse control element is adapted to allow collapse of the transducer element, and adapted to remedy a collapsed condition with a discharge element operatively coupled to the transducer element and adapted to discharge the transducer element for a predetermined discharge time.

5. The condenser microphone according to claim 4, wherein the predetermined discharge time has a duration between 1 ms and 1 second.

6. The condenser microphone according to claim 4, wherein the discharge element includes a controllable MOS transistor.

7. The condenser microphone according to claim 1, wherein the collapse detection element is adapted to determine a capacitance of the transducer element.

8. The condenser microphone according to claim 1, wherein the collapse detection element is adapted to determine the physical parameter value by applying a probe signal to the transducer element.

9. The condenser microphone according to claim 8, wherein the probe signal includes a signal selected from the group consisting of: DC signals and ultrasonic signals.

10. The condenser microphone according to claim 1, wherein the collapse detection element includes a capacitive divider having a cascade between a fixed capacitor and a capacitance of the transducer element.

11. The condenser microphone according to claim 1, wherein the collapse detection element is responsive to a sound pressure impinging on the diaphragm.

12. The condenser microphone according to claim 11, wherein the collapse detection element includes a sensor microphone positioned in proximity to the transducer element and operatively coupled to the collapse control element.

13. The condenser microphone according to claim 1, wherein the collapse detection element is adapted to detect a peak voltage generated by the transducer element.

14. The condenser microphone according to claim 1, wherein the collapse control element is adapted to reduce a DC bias voltage across the transducer element based on the determined physical parameter value.

15. The condenser microphone according to claim 14, wherein the collapse control element includes a bias current monitoring element adapted to detect a DC current flow from the DC bias voltage element to the transducer element.

16. The condenser microphone according to claim 14, wherein the collapse control element is adapted to electrically connect the diaphragm and the back-plate upon the determined physical parameter value exceeding a predetermined threshold.

17. The condenser microphone according to claim 14, wherein the collapse control element comprises a controllable element adapted to generate an electrical pulse with a predetermined duration and amplitude based on the determined physical parameter value, and a switch element adapted to receive the electrical pulse and to electrically connect the diaphragm and the back-plate in response to a receipt of the electrical pulse.

18. The condenser microphone according to claim 14, wherein the collapse control element is adapted to reduce the DC bias voltage based on the determined physical parameter value.

19. The condenser microphone according to claim 1, wherein the transducer element includes a silicon transducer.

20. The condenser microphone according to claim 19, wherein the silicon transducer is implemented on a first silicon substrate, and wherein the collapse detection element and the collapse control element are implemented on a second silicon substrate.

21. The condenser microphone according to claim 19, wherein the silicon transducer, the collapse detection element and the collapse control element are monolithically integrated on a single die.

22. The condenser microphone according to claim 21, wherein the die further includes a preamplifier operatively coupled to the transducer element.

23. An electronic circuit for a condenser microphone having a transducer element, the circuit comprising:

a DC bias voltage element to couple to a condenser microphone diaphragm and a back-plate;

a collapse detection element adapted to determine a physical parameter value related to a separation between the diaphragm and the back-plate of the condenser microphone; and a collapse control element adapted to control the DC bias voltage element based on the determined physical parameter value.

24. The electronic circuit according to claim 23, wherein the collapse detection element is adapted to determine a capacitance of the transducer element.

25. The electronic circuit according to claim 23, wherein the collapse detection element is adapted to determine the physical parameter value by applying a probe signal to the transducer element.

26. The electronic circuit according to claim 23, wherein the collapse detection element is adapted to detect a peak voltage of the transducer element.

27. The electronic circuit according to claim 23, wherein the collapse control element is adapted to adaptively reduce a DC bias voltage based on the determined physical parameter value.

28. The electronic circuit according to claim 23, wherein the collapse control element includes a discharge element operatively coupled to the transducer element and adapted to discharge the transducer element for a predetermined discharge time.

29. A method of operating a condenser microphone comprising:

transducing an acoustic signal into an electrical signal with a transducing element having a diaphragm and a back-plate;

determining a physical parameter value that relates to a separation between the diaphragm and the back-plate; and maintaining an appropriate separation between the diaphragm and the back-plate by controlling a DC bias voltage between the diaphragm and the back-plate.

controlling a DC voltage between in response to the physical parameter value to maintain.

30. The method according to claim 29, further including remedying a collapsed condition with a discharge element operatively coupled to the transducer element and adapted to discharge the transducer element for a predetermined discharge time.

* * * * *